US006034619A

United States Patent [19]

Osborne et al.

[11] Patent Number: 6,034,619

[45] Date of Patent: Mar. 7, 2000

[54] DIGITAL ALARM RECEIVER FOR AUTOMATED HANDLING OF DATA FORMATS

[76] Inventors: Paul Wray Osborne; Edwin Hoffman, both c/o Osborne- Hoffman, Inc, 304 Richmond Ave, Point Pleasant Beach, N.J. 08742

[21] Appl. No.: 08/139,642

[22] Filed: Oct. 12, 1993

Related U.S. Application Data

[63] Continuation of application No. 07/561,816, Jul. 1, 1985, abandoned, which is a continuation-in-part of application No. 06/404,303, Aug. 2, 1982, abandoned.

[51] Int. Cl.[7] ..... G08B 5/22

[52] U.S. Cl. ..... 340/825.36; 379/93.01; 379/106.06; 340/825.44

[58] Field of Search ..... 340/825, 825.36, 340/825.37, 825.48, 502, 506, 531; 379/97, 47, 235, 360, 361, 106, 389, 93.01, 106.06; 375/8; 455/343; 370/84

[56] References Cited

U.S. PATENT DOCUMENTS

| | | | |
|---|---|---|---|
| 3,713,125 | 1/1973 | Miller | 340/539 |
| 3,925,763 | 12/1975 | Wadhwani et al. | 340/825.36 |
| 3,937,889 | 2/1976 | Bell, III et al. | 340/531 |
| 4,076,965 | 2/1978 | Olsen et al. | 379/235 X |
| 4,162,488 | 7/1979 | Silverman et al. | 340/505 |
| 4,249,036 | 2/1981 | Kutzki | 340/502 |
| 4,253,088 | 2/1981 | Sado et al. | 340/825.36 |
| 4,258,357 | 3/1981 | Browell | 340/533 |
| 4,412,292 | 10/1983 | Sedam et al. | 340/825.36 X |
| 4,454,502 | 6/1984 | Fahey et al. | 340/506 |
| 4,471,352 | 9/1984 | Soulliard et al. | 340/825.44 |
| 4,486,750 | 12/1984 | Aoki | 340/825.14 X |
| 4,499,455 | 2/1985 | Leveille et al. | 340/531 |
| 4,518,961 | 5/1985 | Davis et al. | 340/825.44 |

OTHER PUBLICATIONS

"Alarm Com—a Computer–Controlled Alarm Communication System," Claes Hagland et al. *Ericsson Review* vol. 56, No. 4, 1979.

*Primary Examiner*—Amare Mengistu

[57] ABSTRACT

A digital alarm receiver interacts with a multiplicity of transmitters having a plurality of different transmitter formats. The receiver adapts automatically to different formats received over the same input line. A series of different handshake signals are emitted by the receiver until a response is evoked. The received message is displayed and a record of the message as well as a description of the resulting action taken by the operator are printed. Messages which normally arrive at predetermined times are handled by the receiver without requiring any operator action. A failure of an expected message to arrive, or the arrival of a message outside its expected time slot, result in an alarm condition which requires operator action.

14 Claims, 12 Drawing Sheets

DIGITAL ALARM RECEIVER FOR AUTOMATED HANDLING OF DATA FORMATS

This is a continuation of application Ser. No. 07/561,816 filed Jul. 1, 1985 which is abandoned, which in turn is a continuation-in-part of application Ser. No. 06/404,303 filed Aug. 2, 1982 which is abandoned.

BACKGROUND OF THE INVENTION

Since the early 1970's, digital communicators have been in increasing use for reporting alarm or status conditions to central monitoring stations. The digital communicators, which use a digital stream of data to denote the reporting account number and status code, improve upon the previously used tape dialers which utilize a tape recorded message to identify the calling location.

As digital communicators evolved, the digital stream of data acquired different formats. A number of models are designed for pulsed transmissions at slow rates of 10 pulses per second. Faster pulsed rates, at 20 pulses per second, came in vogue when the need to conserve line capacity and to speed the handling of alarms became evident. It was found however in some locations that due to noise and other degradations in the transmission medium, the faster pulse rate was less reliable than the slow pulse rate. This led to the manufacture of transmitters with "Touch-Tone" (Touch-Tone is a trademark of AT&T), generically known as DTMF (Dual Tone Multiple Frequency), formats which combine super fast transmission with high reliability. For example, 15 distinct pulses are required in the pulsed formats to transmit the letter F, whereas only one DTMF pair is required for any hexadecimal symbol.

Each of the different transmission formats requires a given protocol between transmitter and receiver. This protocol consists of frequency coded handshake signals and kiss-off signals. The handshake signal is emitted by the receiver to initiate transmission of data by the transmitter. The kiss-off signal is emitted by the receiver to signal that data has been received correctly. The presence of the handshake and kiss-off signals at appropriate times is necessary for communications. Because the various formats require different kiss-off and handshake signals, it has been required in the past to segregate transmitters of different formats onto separate communication lines. This invention permits mixing of different formats on the same communications line.

When several reports are received within a short interval of time, the operator needs to note each arriving report as it is displayed on the receiver. For each report different operator action may be required. The action is often of urgent nature, such as a call for help to police, fire department, ambulance or other emergency service. Because of the possibility of human error, busy periods may result in failure to service alarms. This invention describes means to store and display the arriving data so as to provide the operator with an organized display. The organization described in this invention ensures that each received call is serviced by the operator. When the operator takes action on a received call, notation of the action in a log is required. With past equipment, the action log is often kept in a notebook separate from the receiver and with date and time independently entered. This invention describes means to enter the action log into the receiver and of permanently storing the action log with date and time automatically entered by the receiver. This improvement results in the joint storage of received messages and the resulting action log.

A further improvement relates to reception of analog data in combination with receptions from digital communicators. In the past, separate modems and receivers from the receiver used to acquire digital alarms were needed for analog data. The improved receiver allows analog information, the precise value of a parameter, as well as digital data to be received.

A further improvement relates to the automatic handling of messages which normally arrive at predetermined times. Examples of such messages are reports of openings and closings of commercial businesses. Past procedure has been to track these calls manually. This usually involves punching time cards for each account by the operator. This procedure is time consuming and error prone. This invention describes automatic tracking of normal events such as openings and closings. The receiver signals distinctly when a call arrives due to a normal event, when a call arrives outside its expected time slot, and the failure of an expected message to arrive.

Another feature of this improvement is the monitoring by the receiver of faulty or disconnected transmitters. This invention applies to automated monitoring of transmitters programmed to report at least once within a prescribed interval, for example once a day. The invention gives a distinct indication when it fails to receive a message from a transmitter in its assigned interval.

SUMMARY

The field of this invention relates to receivers of alarm and status reporting messages over telephone lines, leased wires, and radio links. One object of this invention is to provide means for automated reception of several different pulsed and tone burst transmission formats over the same line or link.

Another object is to organize and display received messages to ensure operator attention to each when a multiplicity of messages arrive within a short period of time.

A further object is to provide means for the operator to log and permanently record the action taken relative to each message and for automatically recording the date and time of entry on the same medium on which said message is recorded.

It is also an object of this invention to provide means for receiving and displaying analog status signals. Yet another object is to provide means for automated monitoring of messages expected to arrive at predetermined times, such as openings and closings of stores, and to identify transmissions which fail to arrive when expected.

DRAWINGS

FIG. 1(*b*) shows the timing diagram of the FHS, Data and FKO signals.

FIG. 1(*c*) shows the timing diagram of a sequence of FHS signals.

FIG. 1(*d*) shows a preferred implementation of Line Receiver 8 of above cited FIG. 1(*a*).

FIG. 1(*e*) shows a flow diagram of the program for the CPU based system of FIG. 1(*a*) for automatically adapting to different formats.

FIG. 8(*b*) shows a flow diagram for the CPU based system of FIG. 4 for printing and displaying received analog data.

FIG. 9(*b*) shows a flow diagram of the program for the CPU based system of FIG. 5 for deciding the validity of the opening, closing and test status of received signals.

FIG. 9(*c*) shows a flow diagram of the program for the CPU based system of FIG. 5 for controlling the printout of accounts which fail to open, close, or test normally.

DESCRIPTION OF THE PREFERRED EMBODIMENT

Figure 1:
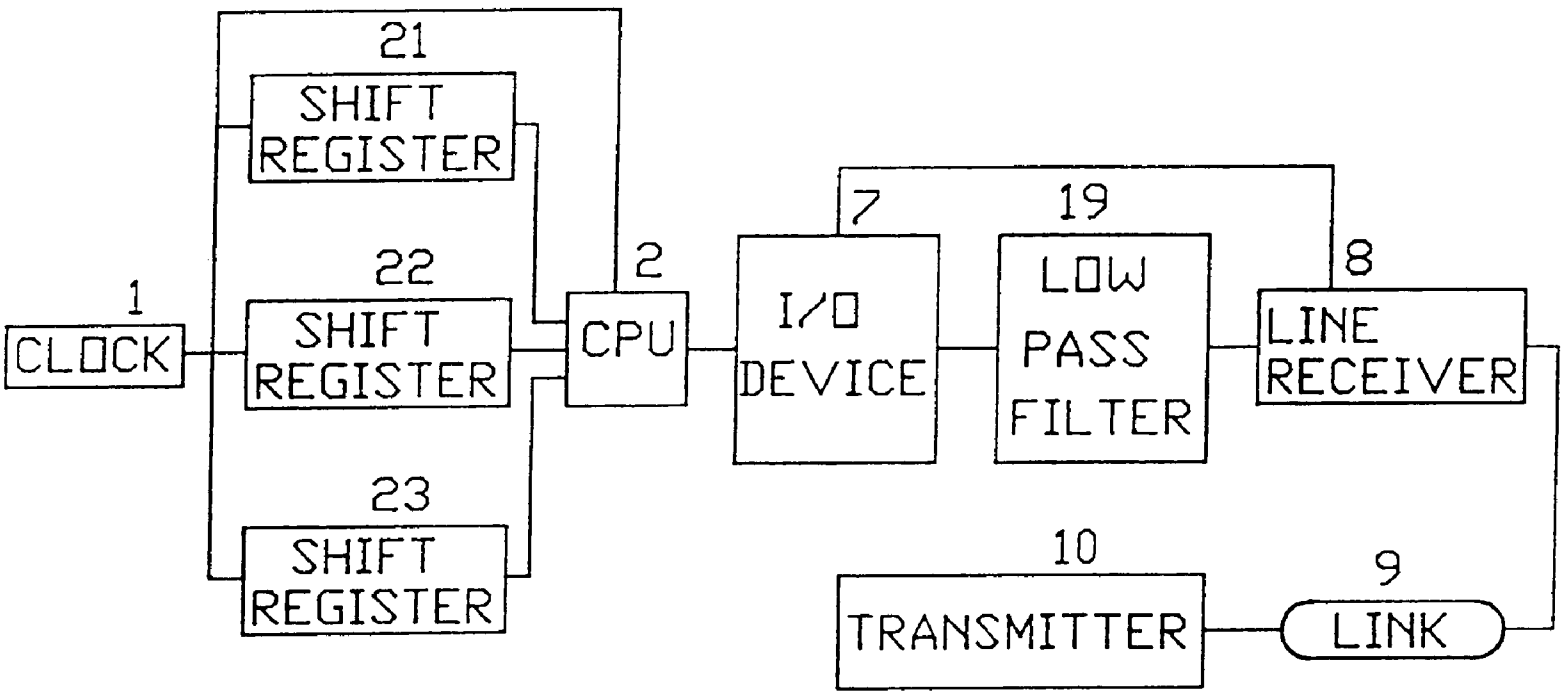
FIG. 1(*a*) shows the hardware components of the improved Digital Alarm Receiver.
Figure 1B:
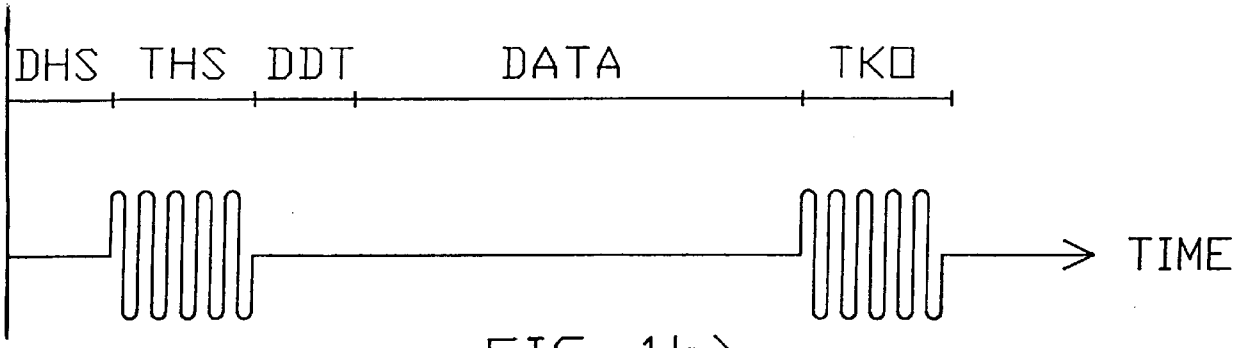
Figure 1:
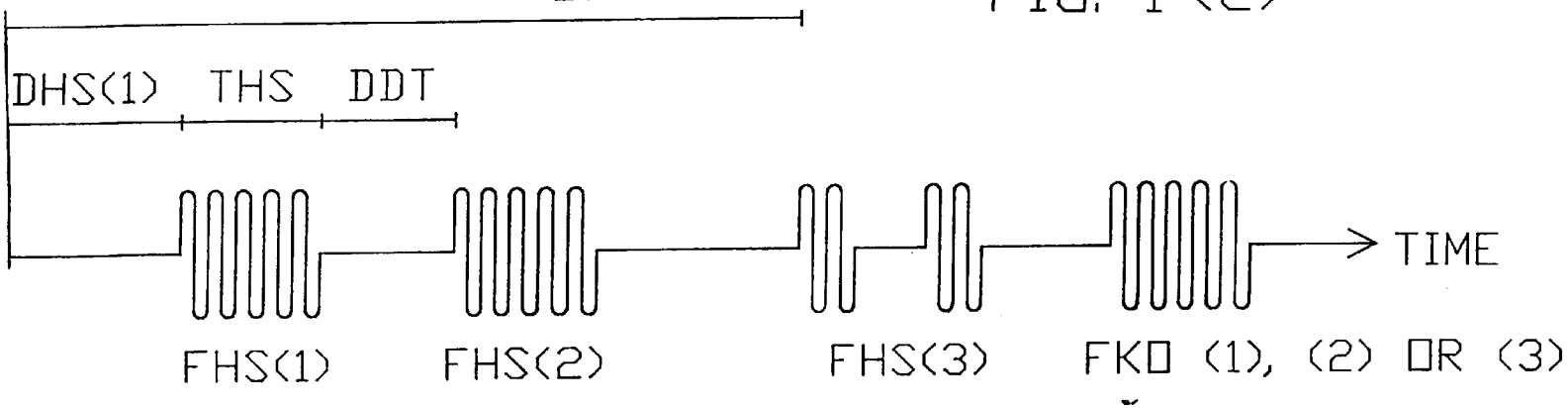
Figure 1:
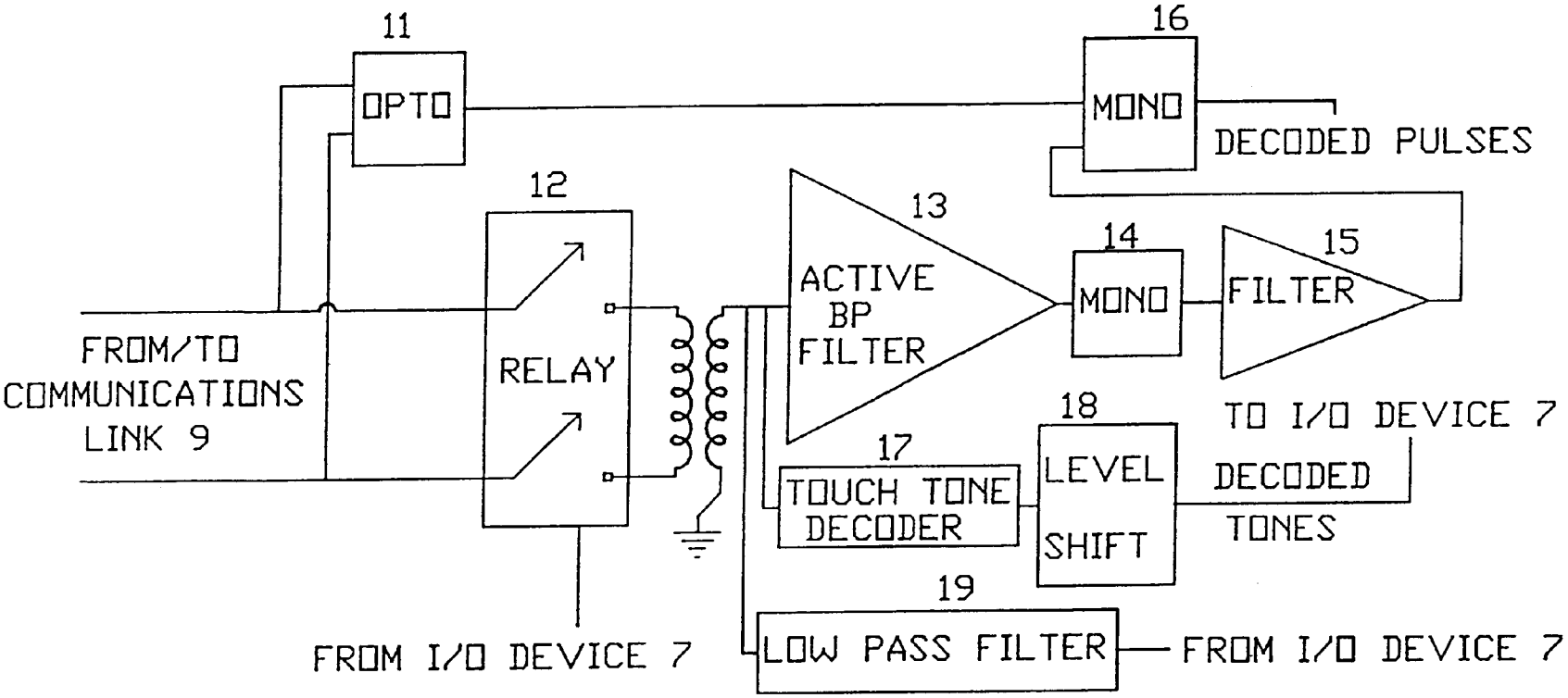
Figure 1:
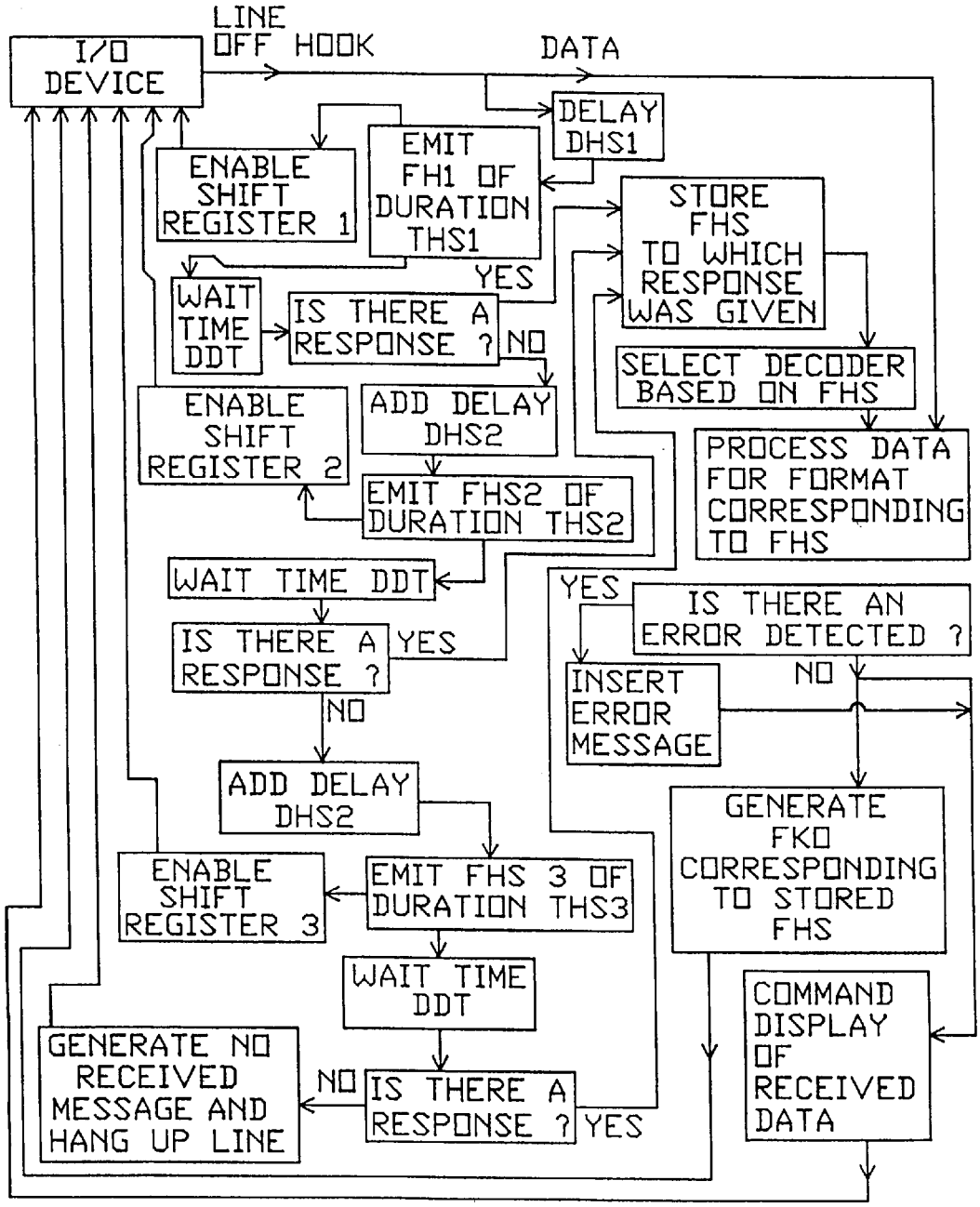

Reference is made to FIG. 1(*a*) which shows an improved digital alarm receiver handling a plurality of different transmitter data formats. Transmitter 10 sends data to Line Receiver 8 over Communications Link 9. Transmitter 10 receives signals from Line Receiver 8 over Communications Link 9. The protocol for typical communications is shown in FIG. 1(*b*). Connection of Transmitter 10 to Line Receiver 8 begins at time A.

Several different transmitter formats are in present use. Each format has a corresponding protocol. This improvement describes means of receiving different formats over the same communications link with the same receiver. After a delay DHS, a frequency coded handshake message FHS of time duration THS is sent by the receiver to the transmitter. The parameters DHS, FHS and THS vary for different transmission formats. The transmitter begins data transmission at time not exceeding DDT after it receives its appropriate handshake message. The coded data stream contains error checking elements. Once the receiver has received an error free data transmission, it sends a kiss-off message FKO of time duration TKO. The parameters FKO and TKO vary for different transmission formats. When an error is detected, no kiss-off message is sent and the data is repeated. FIG. 1(*c*) shows a protocol of an improved receiver, which handles a plurality of formats. The improved receiver emits a sequence of handshake signals FHS(1), FHS(2), FHS(3), at times DHS(1), DHS(2), DHS(3), corresponding to the requirements of the different data formats which are specified by the manufacturer of the alarm transmitter. If data is transmitted after the receiver emits FHS(1), the data format is of type 1. If no response is obtained, FHS(2) is transmitted. If data is transmitted after the receiver emits FHS(2), the data is of format type 2. This sequence continues until a response is obtained. The receiver by means of CPU control selects the data processing according to data type and selects the kiss-off signal emitted after data has been received to also correspond to the data format type. The different handshake signals are ordered in a sequence according to their minimum DHS. The handshake message FHS(1) corresponding to the least DHS is transmitted first. If no data reception has begun a time delay DDT later, the receiver transmits FHS(2) corresponding to the next minimum DHS. If no data reception has begun within a delay DDT later, the receiver transmits FHS(3). This procedure is repeated until the different formats to which the receiver is exposed are covered. A permutation in the order occurs when the maximum DHS for a particular FHS is reached. The order of that particular FHS is interchanged with an FHS of shorter maximum DHS. In FIG. 1(*a*), Clock 1 drives Shift Registers 21, 22, 23 which are preset with digital bits corresponding to codes FHS(1), FHS(2), FHS(3) respectively, and which transmit a digital bit stream under control of Central Processor Unit (CPU) 2. The preset digital bits are selected in accordance with the specifications for the various FHS. For example, suppose Clock 1 is set at 1 KHz, and FHS(1) is to be a single tone of 500 Hz of duration THS(1) of 200 mS. Shift Register 21 therefore is set for a sequence 001100110011 etc. which corresponds to a square wave of 500 Hz. The 0011 subsequence is repeated 100 times since each subsequence is 2 mS long. In Low Pass Filter 19 the square wave is filtered to a sine wave. Clock 1 provides timing pulses to CPU 2, which initiates the timing cycle at time A of FIG. 1(*c*) upon receipt of a pulse through Input/Output Device (I/O Device) 7, which pulse originates at Line Receiver 8, upon connection to Transmitter 10 through Communications Link 9. CPU 2 begins count of least DHS from time A, initiates FHS(1) from Shift Register 21 when least DHS is reached, and transmits FHS(1) to I/O Device 7 which drives Low Pass Filter 19, which shapes FHS(1) to conform to frequency specifications. The shaped wave of Low Pass Filter 19 is connected to Line Receiver 8 which sends FHS(1) to Transmitter 10 through Link 9. Transmitter 10 responds to FHS(1) with transmission of data in format (1) if Transmitter 10 is a format (1) type of transmitter. Otherwise, it does not respond. When format (1) data is transmitted, Line Receiver 8 is provided with timing signals from CPU 2 causing format (1) data to be detected. Data received from transmitter 10 by Line Receiver 8 is transferred to I/O Device 7. I/O Device 7 is scanned by CPU 2 which is clocked by pulses from Clock 1. The scanning of I/O Device 7 by CPU 2 causes CPU 2 to detect the start of signaling. At the conclusion of transmission of format (1), when no errors are detected, digital bits generated in CPU 2 are loaded into Shift Register 21 which correspond to FKO(1). Clock 1 provides timing pulses to CPU 2 which causes CPU 2 to cycle through its program. The successive stages of Shift Register 21, 22, 23 have been preset to logic levels one and zero in accordance with the frequency requirements of FHS(1), FHS(2), FHS (3). Most commonly, the frequency and duration of FKO correspond to the FHS which caused data to be transmitted. When this is not the case, Shift Registers are added to the system and preset to correspond to the different FKO requirements. The presetting is done in the same way as for the FHS specifications. Clock 1 drives Shift Register 21 at a rate which generates a coded FKO(1) of duration TKO(1) and which is sent to CPU 2, which under control of Clock 1 sends FKO(1) to I/O Device 7 which drives Low Pass Filter 19, which shapes FKO(1) to conform to frequency specifications. The shaped wave FKO(1) of Low Pass Filter 19 is connected to Line Receiver 8 which sends FKO(1) to Transmitter 10 through Link 9. When Transmitter 10 does not respond to FHS(1) within time DDT, CPU 2 initiates transmission of FHS(2). FHS(2) is processed in analogous manner to FHS(1) by blocks 1, 22, 2, 7, 19, 8, 9, and 10. If there is no response to FHS(2) within time DDT, CPU(2) initiates transmission of FHS(3). FHS(3) is processed in analogous manner to FHS(1) by blocks 1, 23, 2, 7, 19, 8, 9, and 10. While FIG. 1(*a*) illustrates an embodiment for 3 different formats, it is evident that this embodiment may be easily extended to a larger number. It is also obvious that the embodiment of this improvement shown in FIG. 1(*a*), while shown for a microprocessor based implementation, may also be implemented using discrete logic.

A preferred embodiment of Receiver 8 of FIG. 1(*a*) is shown in FIG. 1(*d*). While commonly referred to as a "receiver" in the security industry, the circuit of FIG. 1(*d*) might better be referred to as a "transceiver" since both reception (of data) and transmission (handshake and kiss-off) take place. The term receiver is however maintained in this disclosure since this is the commonly used term in the industry.

The communications link is most often an ordinary telephone line. When the phone rings, the ring signal is passed from Link 9 through Optoisolator 11 which serves to isolate the floating input of the telephone line from the ground referenced circuit of the receiver. The signal from Optoisolator 11 causes Mono 16 to emit a series of pulses corresponding to the ringing of the telephone. CPU 2 receives the pulses of Mono 16 through I/O Device 7 and is programmed to cause relay 12 to pick up (take the line off-hook) the communications line. Low Pass Filter 19 filters the FHS and FKO signals generated in CPU 2 from Shift Registers 21, 22, 23 and the FHS signal is transmitted through communications Link 9 causing the Transmitter 10 to send data. Pulsed data is filtered through the Band Pass Filter 13 which passes tone bursts of specified frequencies corresponding to alarm transmitter specifications. The tone burst outputs of Band Pass Filter 13 trigger Mono 14 to emit pulses which are smoothed against noise in smoothing Filter 15 whose output is converted to pulses of fixed duration in Mono 16. The decoded pulses are processed in CPU 2 to show an account number and codes corresponding to the data received. The sequence of this data is part of the specifications which are given by the manufacturer of Transmitter 10, and is stored in CPU 2.

When DTMF is transmitted as data by alarm Transmitter 10, the data is decoded in DTMF Decoder 17. This is a commercially available part from several manufacturers (Teltone Corp, GTE Corp.). The output of Decoder 17 passes through Level Shifter 18 for compatibility with signal levels in I/O Device 7 and CPU 2. The decoded tones are processed in CPU 2 to show an account number and code which correspond to the data specifications of the manufacturer of the alarm transmitter of the DTMF type.

In FIG. 1(*e*) is shown the flow diagram of the program by means of which CPU 2 adapts the receiver to automatically receive different data formats.

The alarm Transmitter 10 initiates communications by dialing a telephone number corresponding to Receiver 8. When Receiver 8 picks up the ring signal generated by the telephone network, reference time A is established. When a direct line rather than a telephone line is used, Transmitter 10 initiates communications by generating a ring signal equivalent.

CPU 2, under the instructions of the software program of FIG. 1(*e*), directs the transmission of the FHS and FKO signals and the reception of data formats. Transmitters with like protocol will respond to like FHS signals. If no data arrives at CPU 2 after the first of a sequence of FHS signals is given, the next FHS signal is transmitted. The sequence continues until a response from the alarm transmitter is evoked. The kind of FHS signal which corresponds to different alarm transmitter formats is known from alarm transmitter manufacturers' specifications. Thus, the FHS to which the transmitter responds clues CPU 2 as to the data format. This information is stored in the memory of CPU 2. After the data is received, CPU 2 is programmed to issue a display command of the received message and to generate a FKO signal which terminates communications.

Figure 2:
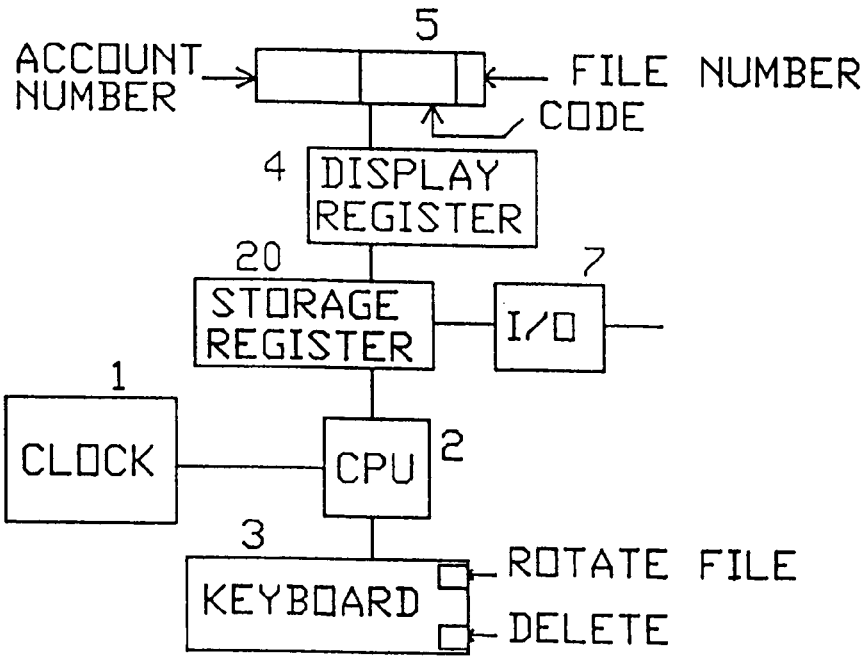
FIG. 2 shows organization of storage and display of a multiplicity of received messages.
Figure 6:
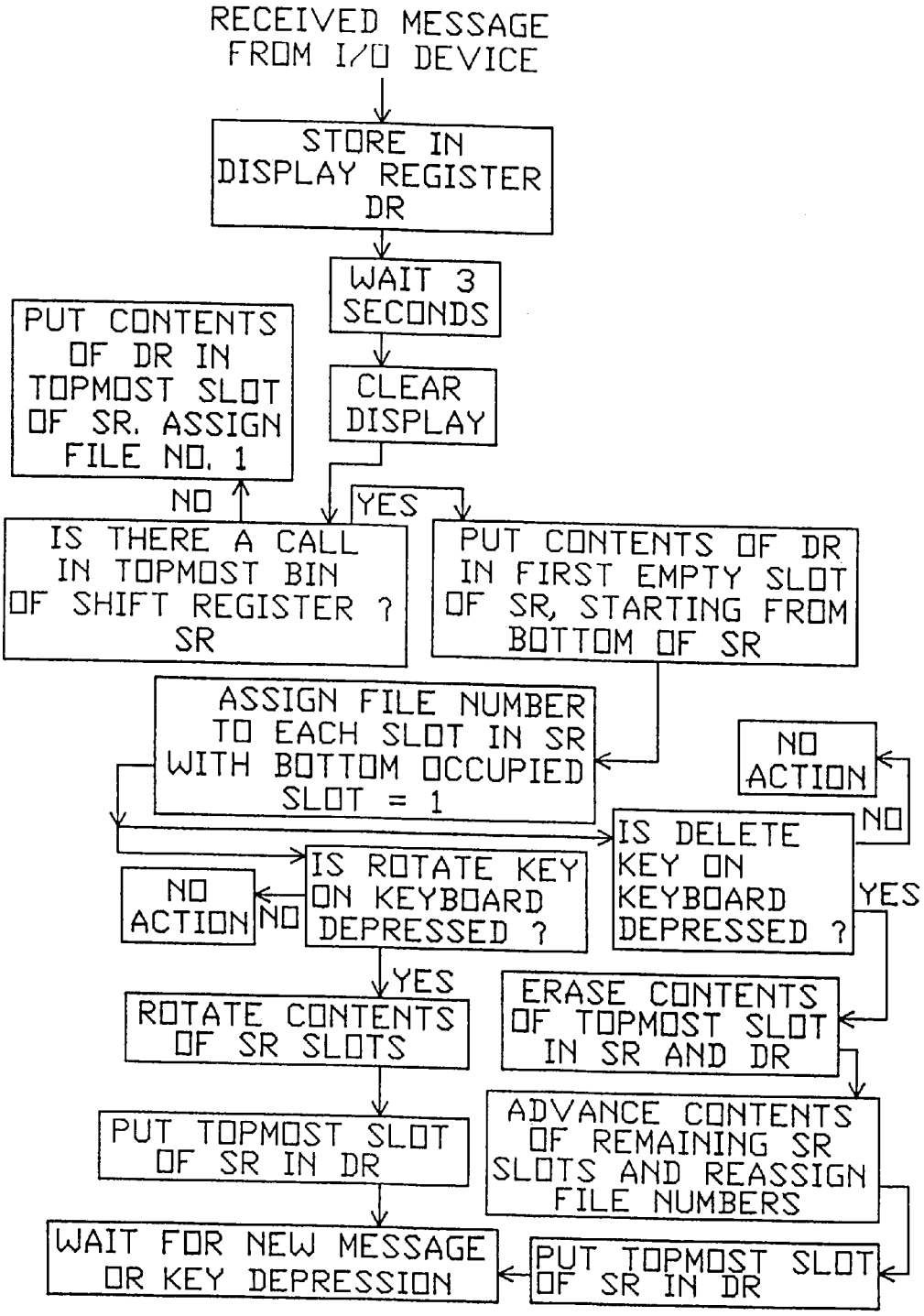
FIG. 6 shows a flow diagram of the program for the CPU based system of FIG. 2 for storage, display and organization of received data.

Reference is made to FIG. 2 which shows organization of storage and display of a multiplicity of received messages. This enhancement to the capability of the receiver of FIG. 1 is performed by connecting to its CPU 2 the added components shown in FIG. 2. The additional software for the CPU is shown in FIG. 6. Received messages are transmitted from I/O Device 7 to CPU 2. For each received message, I/O Device 7 sends a digital stream of bits to CPU 2 which consists of account number or name information and alarm codes. CPU 2 decodes the received message and dumps it into Display Register 4, where data is held for display and driver means are provided to show the account name or number and code of the received message in Display 5. CPU 2 provides control signals to push the received message data from Display Register 4 into Storage Register 20 when Clock 1 which provides timing pulses to CPU 2 has clocked several seconds of elapsed time for the display of the message just received. The received message is pushed into the lower part of Storage Register 20 by means of control pulses from CPU 2 which orders the messages with first arrival in the topmost cell and latest in the bottom of Storage Register 20. Data in the topmost cell of Storage Register 20 is pushed into Display Register 4 by means of control pulses from CPU 2 and is displayed in Display 5. The file number in Display 5 shows the total number of messages stacked in Storage Register 20. Activation of delete key D on Keyboard 3 causes pulses to be transmitted to CPU 2 which cause erasure of data from Display Register 4. CPU 2 causes the stack in Storage Register 20 to advance, with the next message moved to the topmost cell. This message, which now becomes the first in arrival time of messages to be handled by the operator, is shoved into Display Register 4 and is displayed in Display 5, until key D of Keyboard 3 is activated. Keys marked F (Rotate File) and D (Delete) in FIG. 2 are dedicated function keys. Keyboard 3 is arranged in matrix form where depression of a particular key is sensed by means of an electrical resistance change between the column and row in the matrix corresponding to the location of the key. CPU 2 scans Keyboard 3 and senses the activation of a key. The file number is decremented to show the remaining messages to be handled. Depressing file key F on Keyboard 3 causes CPU 2 to send control signals to Storage Register 20 which rotate messages in the stack resulting in the message of the topmost cell to be shifted to the bottom, the message nearest the top to be shifted to the top, and all subsequent messages to be shifted one notch closer to the top. The topmost message in Storage Register 20 is shown in Display 5. Successive depressions of file key F result in moving successive calls into Display 5 thereby permitting complete rotation through all waiting messages. The stack is automatically returned to its initial position with first arrival in the topmost cell, by Clock 1 which activates CPU 2 and which causes rotation of Storage Register 20 to initial position 15 seconds after the stack is stopped at a position where the first arrived message is not in the topmost cell of Storage Register 20.

Figure 3:
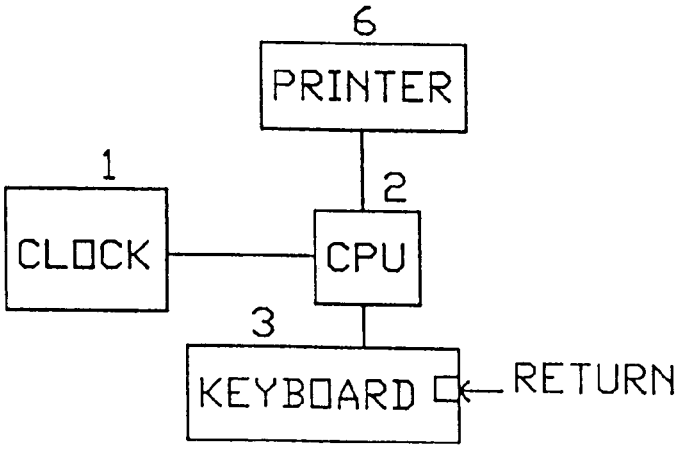
FIG. 3 shows means of logging operator entries.
Figure 7:
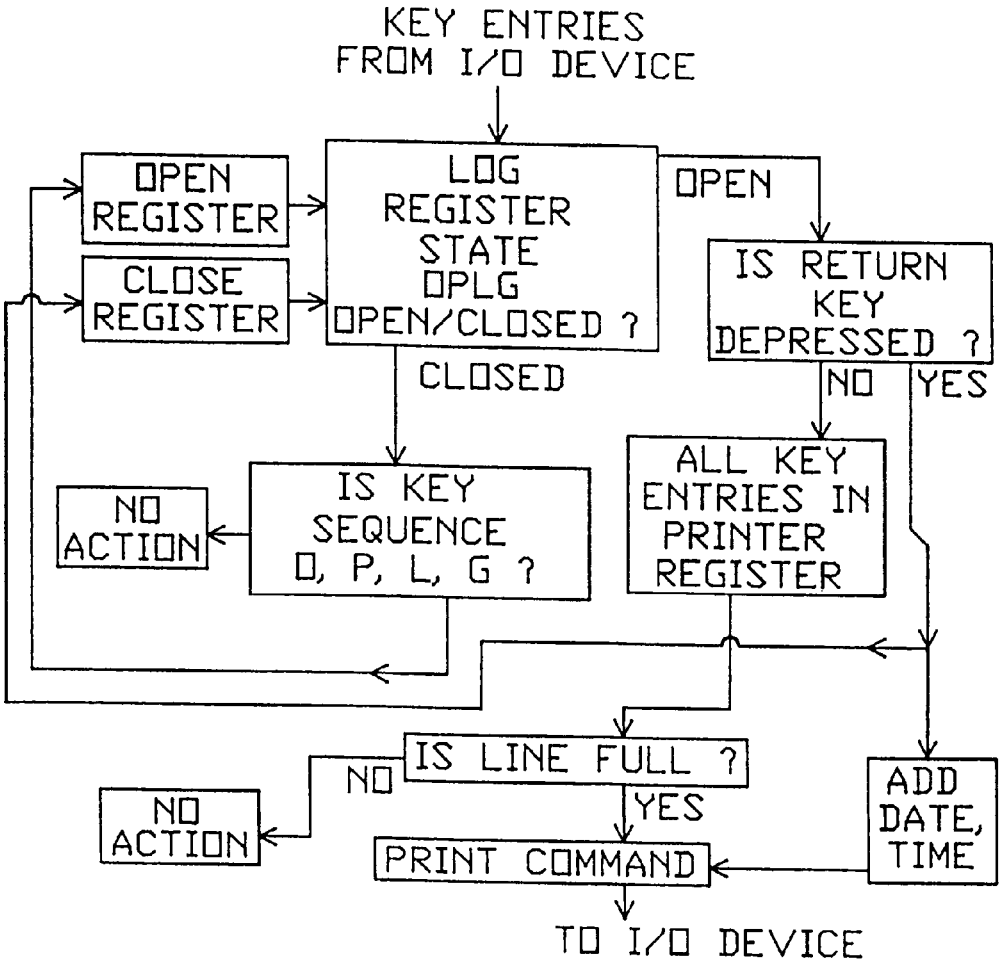
FIG. 7 shows a flow diagram of the program for the CPU based system of FIG. 3 for logging operator entries.

Reference is made to FIG. 3 which shows means of logging operator entries. These entries are made upon taking action on a received message, to note operator name or code, and for operator comments. This enhancement to the capability of the receiver of FIG. 1 is implemented by connecting to its CPU the added components shown in FIG. 3 and by addition of the software of FIG. 7 to its CPU program. Clock 1 sends pulses to CPU 2 which is programmed to maintain a permanent calendar. Entry of time and date upon initiation of use from keyboard 3 causes CPU 2 to maintain correct time and date from then on, in conjunction with clock pulses from Clock 1. Keyboard 3 contains a full ASCII complement of keys and permits operator entries in English. Entries from Keyboard 3 are prefixed by keying OPLG which stands for operator log, followed by whatever the operator desires to log. Keyed entries from Keyboard 3 are transmitted to CPU 2 which provides pulses to Printer 6 causing the entries from Keyboard 1 to be permanently recorded. The key marked R (Return) in FIG. 3 is a dedicated key. CPU 2 scans keyboard 3 and senses the activation of any key. Upon activation of the R (Return) key, CPU 2 is caused to send pulses to Printer 6 resulting in time and date to be logged automatically.

Figure 4:
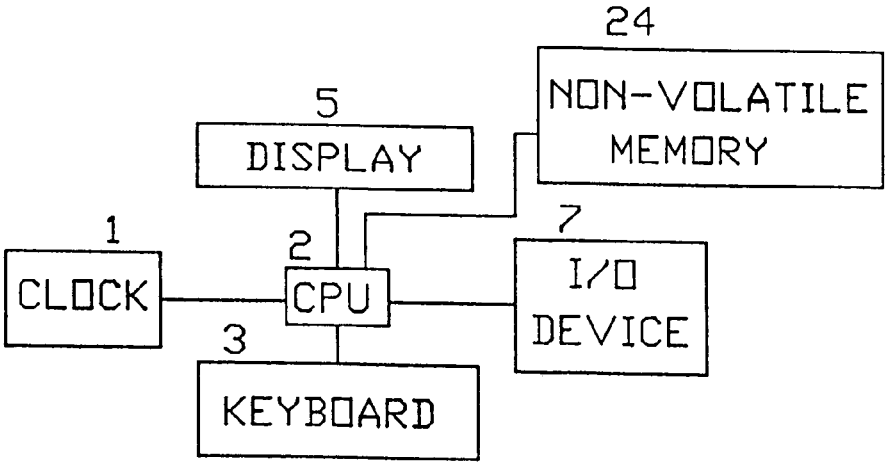
FIG. 4 shows reception and display of analog data.
Figure 8A:
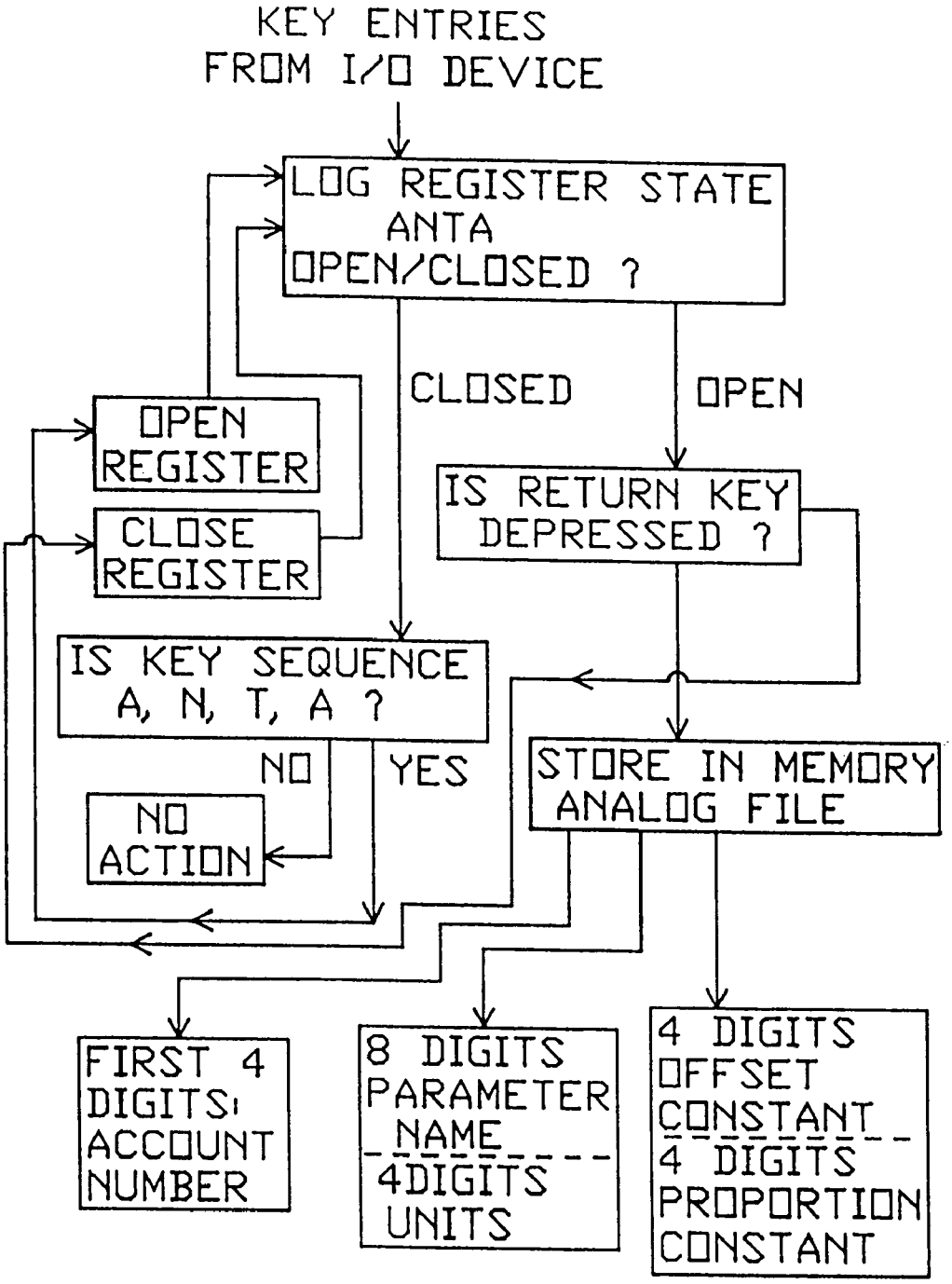
FIG. 8 (*a*) shows a flow diagram of the program for the CPU based system of FIG. 4 for storing parameters for analog data reception.
Figure 8B:
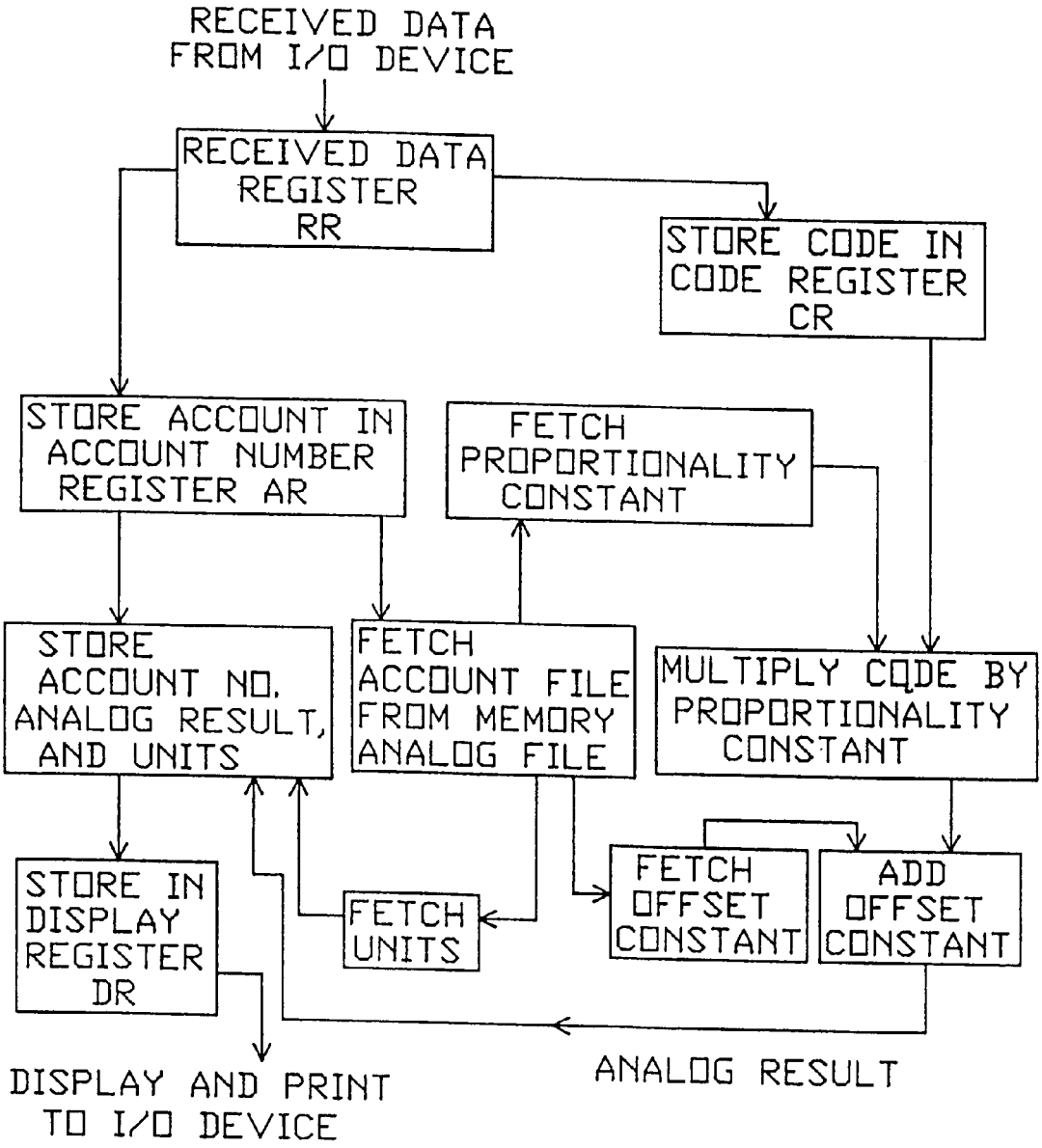

Reference is made to FIG. 4 which shows reception and display means for analog data. This enhancement to the capability of the receiver of FIG. 1 is implemented by connecting to its CPU the added components shown in FIG. 4 and by the addition of the software of FIG. 8 to its program. Entries from Keyboard 3 are preceded by keying ANTA (stands for analog table) and consist of a table of account names or numbers, the name and unit of the parameter measured for each account, and an offset and proportionality constant for each. Entries from Keyboard 3 are transmitted to CPU 2, which receives pulses from Clock 1 causing entries from Keyboard 3 to be stored in Memory 24. A typical entry may read for example:

| | | |
|---|---|---|
| 123 TEMP | ° C. | −5, +0.25 |

The first entry stands for account number 123, followed by the parameter measured and its units, in this case temperature in degrees Centigrade, followed by an offset of −5 and a proportionality constant 0.25. When a message is received through I/O Device 7, the data is clocked into CPU 2 by means of Clock 1. CPU 2 decodes the account number and fetches the offset and proportionality constants from Memory 24. CPU 2 operates arithmetically on the code in the message with the offset and proportionality constants, whereby binary multiplication is performed upon the received code with the proportionality constant and addition is performed with the offset constant. The result of the arithmetic is presented by CPU 2 to Display 5 along with the decoded account number and stored parameter data in Memory 24. As a result, if for example a message with account number 123 and code 74 were received in binary digital form 01001010, CPU 2 applies the constants to compute in binary arithmetic $(74\times0.35)-5=13.5$, and Display 5 shows:

ACCOUNT 123: +13.5° C.

Figure 5:
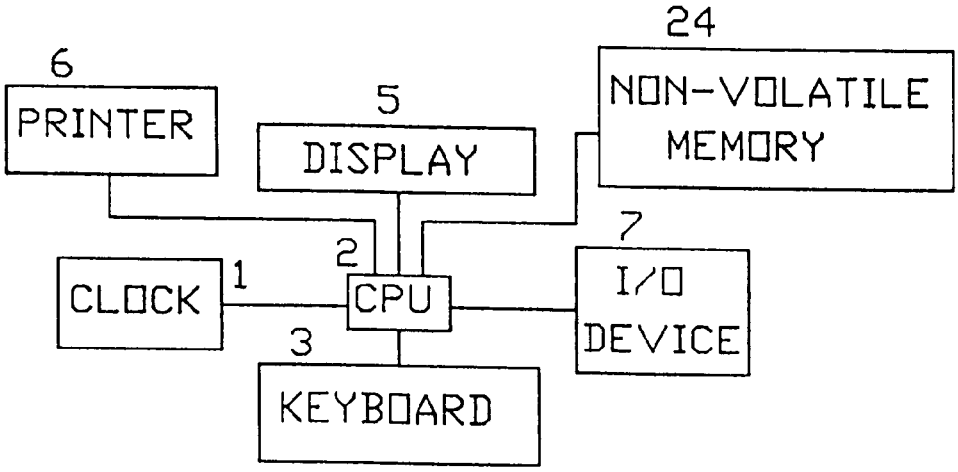
FIG. 5 shows monitoring of messages which normally arrive at predetermined times or intervals.
Figure 9A:
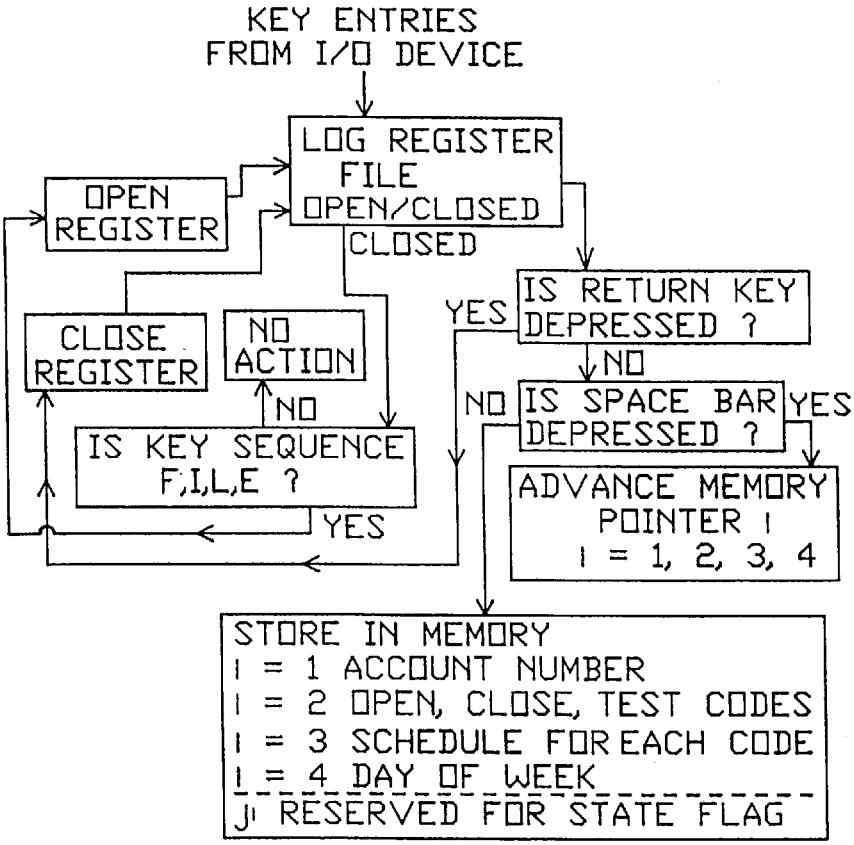
FIG. 9(*a*) shows a flow diagram of the program for the CPU based system of FIG. 5 for storing parameters for openings and closings and test schedules.
Figure 9B:
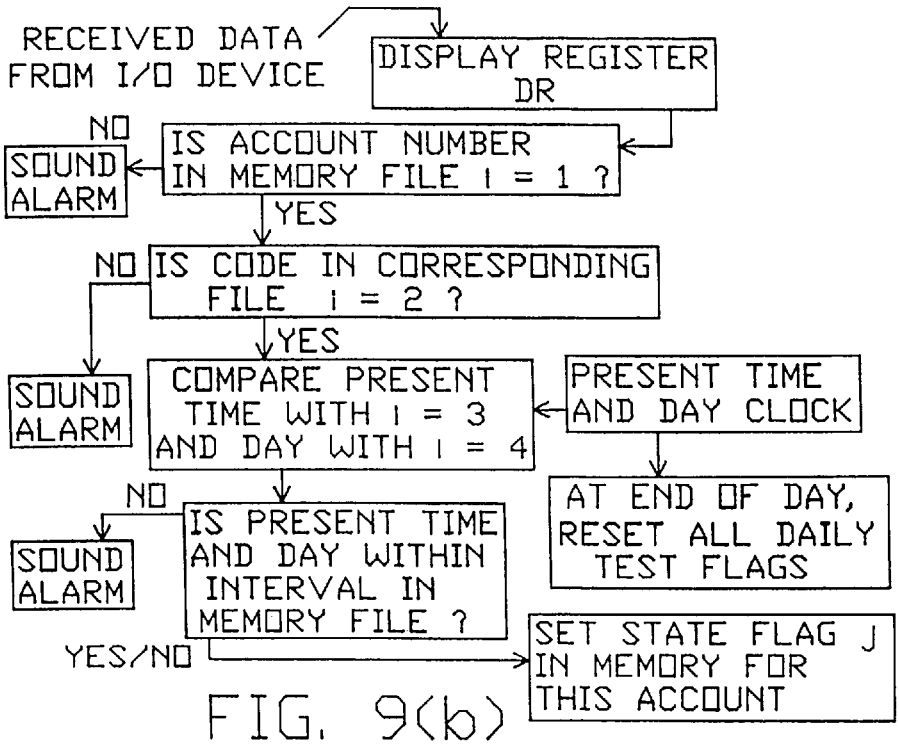
Figure 9C:
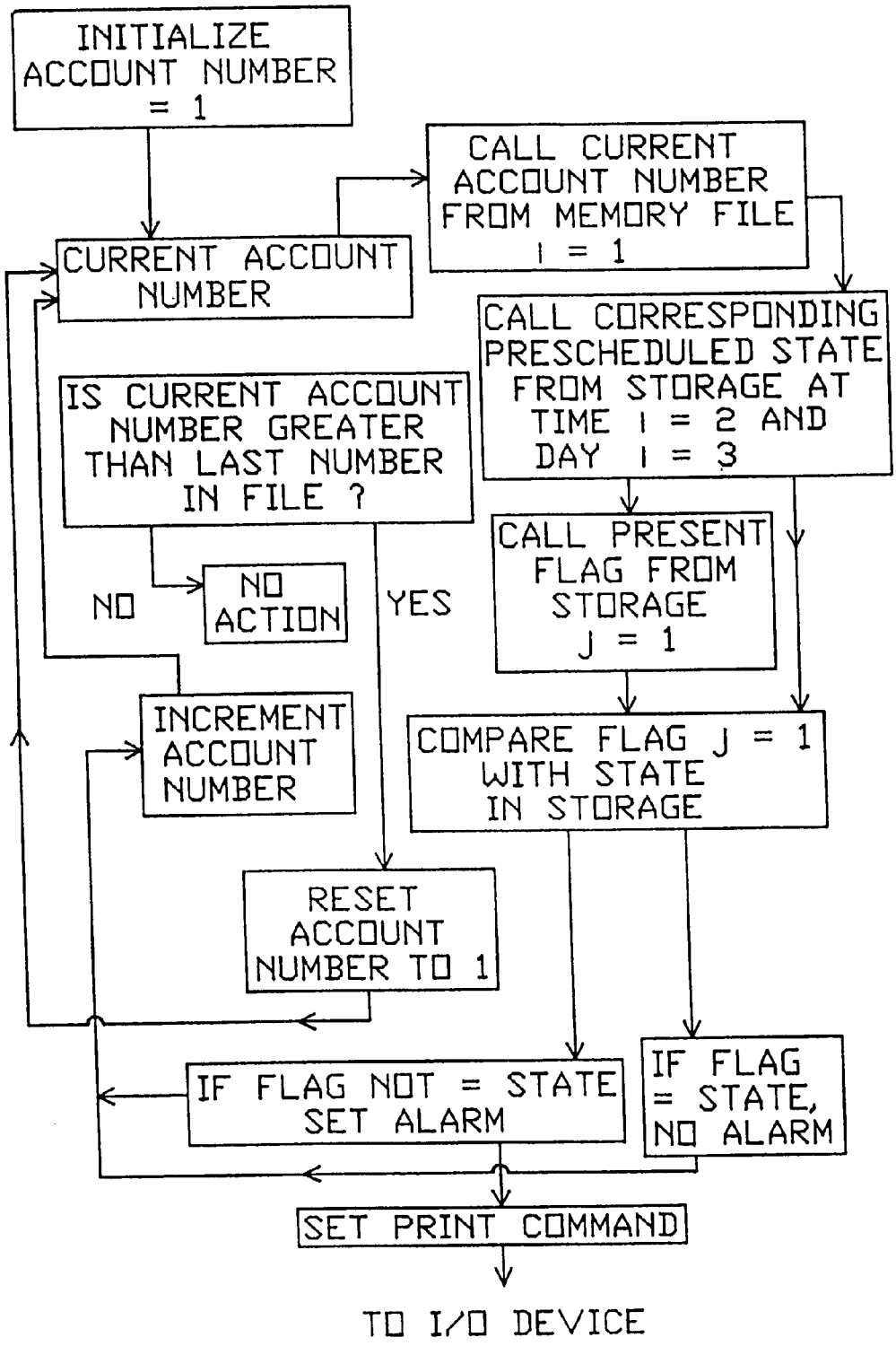

Reference is made to FIG. 5 which shows means to automatically monitor messages which normally arrive at predetermined times or intervals. This enhancement to the capability of the receiver of FIG. 1 is implemented by connecting to its CPU the added components of FIG. 5 and by the addition of the software of FIG. 9 to its program. Examples of such messages are opening and closing signals and daily test signals. An operator enters from Keyboard 3 the table of accounts, codes for each account, expected time of receipt of codes for each account and dates or days of the week of expected arrival. Also entered where applicable is the interval of time within which a code for each account is expected. Keyboard 3 is scanned by CPU 2 for keyed entries which are signaled by an electrical resistance change upon depression of a key. Entries from Keyboard 3 are pulsed into CPU 2 which receives clock pulses from Clock 1 and which provides a binary stream to Memory 24. Memory 24 is non-volatile, and stores the table entered from Keyboard 3. Upon initial use of the invention, time and date are entered from Keyboard 3. Initial time and date are pulsed into CPU 2 which by means of clock pulses provided to it by Clock 1, maintains time and date continuously. A message received at I/O Device 7 is transmitted to CPU 2 which decodes the account number and code. Digital pulses from CPU 2 enable Memory 24 and a search is made for the account number and code just decoded. When the account and code is found in the table of Memory 24, comparison is made with the actual arrival time and the expected arrival time listed in the table of Memory 24 by CPU 2. Validation of arrival time is made within a user programmable time window entered from Keyboard 3 into CPU 2. A validated message is transmitted from CPU 2 to Display 5 with a notation to show validation. Printer 6 is activated by CPU 2 which provides print pulses causing validation data, account number, code, date and time to be printed. For example, a validated "opening" call from account number 123 is printed:

| | |
|---|---|
| DATE: 07/01/82<br>OPENING 123 | TIME: 09:30<br>CODE: A |

CPU 2 tags each account with a digital tag in Memory 24 when the predetermined time window criterion is satisfied. If the predetermined time window elapses with no digital tag on an account listed in the table of Memory 24, CPU 2 transmits pulses to Printer 6 which generates a printout which lists accounts having failed to report as expected. For example, were account 123 fail to open as expected, the printout would show:

| | |
|---|---|
| DATE: 07/01/82<br>FAILED TO OPEN:<br>123 | Time: 09:45 |

Accounts which normally report within a predetermined interval are treated in an analogous manner to those which report at expected times. A digital tag is placed in Memory 24 adjacent to the account upon receipt of a messages. As CPU 2 scans Memory 24, the list of accounts which have failed to report as expected are transmitted to Printer 6.

Whereas the embodiments have been described for microprocessor based implementations, it is obvious that this invention may also be implemented through discrete logic circuits.

We claim:

1. A digital alarm receiver connected to a telephone, comprising:

(a) a single input line;

(b) operating means connected to said single input line to produce a sequence of a plurality of different handshake signals having respectively different data formats on the single input line to activate a transmitter capable of transmitting a data format until an answer is received in a data format corresponding to one of the sequence of a plurality of handshake signals, and (c) said operating means to produce a kiss-off signal corresponding to the received data format to signal the transmitter that data has been correctly received in said detector.

2. A digital alarm receiver as in claim 1 wherein said operating means includes:

(a) memory means coupled to the single input line to store incoming messages in order of arrival, (b) display means coupled to said memory means to display contents of said memory means continuously until action on a message has been taken, (c) key means coupled to said memory means to delete from said memory means and said display a message which has been responded to, an (d) said key means to rotate said memory means enabling contents of said memory to be shown on said display in sequence.

3. A digital alarm receiver as in claim 1, wherein said operating means includes:

(a) printer means coupled to said line to record received messages, (b) keyboard means coupled to said memory means to log actions taken as a result of said messages, (c) control means coupled to said printer and said keyboard to cause said keyboard log to be recorded on said printer, and (d) timing means coupled to said printer to automatically record on said printer time and date of entries.

4. A digital alarm receiver as in claim 1, wherein said operating means includes comprising:

(a) a reception means to receive and transmit parametric data having a measured value, (b) keyboard means coupled to said reception means to enter for each account parametric data relating to its measured value, (c) memory means coupled to said keyboard means to store said keyboard entries, (d) adder and multiplier means coupled to said memory means and operating with said memory stored parametric data upon received digital data to convert received digital data to analog value, and (e) display means coupled to said adder and multiplier means to display analog values computed in said adder and multiplier.

5. A digital alarm receiver as in claim 1 wherein said operating means includes:

(a) keyboard means to enter a table of accounts including account numbers, codes for each account, and expected time and date for each code for each transmitter, (b) CPU means coupled to said keyboard means to recognize entries from a keyboard and means to transfer said entries into memory, (c) memory means coupled to said CPU means to store said entries entered from said keyboard, (d) clock means coupled to said CPU means to provide continuous calendar date and time to said CPU means, (e) software means coupled to said CPU means to control said CPU means to compare date time and code of received message for each account with said timing means and said table in memory, (f) I/O device means coupled to said CPU means to transfer received messages into said CPU means, and (g) display and printer means coupled to said CPU means to show the arrival of a message at its expected time and date to show the failure of a message to arrive at its expected time and date.

6. A digital alarm receiver as in claim 1, wherein said operating means is connected to said single input line for producing a kiss off signal having the same format as the format of the handshake signal.

7. A digital alarm receiver as in claim 1, wherein said operating means is connected to said single input line for producing a kiss off signal having a same format different from the format of the handshake signal.

8. A digital alarm receiver connected to a telephone line, comprising:

(a) a single input line (b) operating means connected to said single input line to produce a sequence of a plurality of different pulsed and dual-tone multi-frequency data format handshake signals having respectively different data formats on the same input line to activate a transmitter capable of transmitting a data format until an answer is received in a data format corresponding to one of the sequential handshake signals, and (c) said operating means to produce a kiss-off signal corresponding to the received data format to signal the transmitter that data has been correctly received in said detector.

9. A digital alarm receiver, comprising:

line receiver means for connection to a transmitter responsive to a handshake signal;

operating means connected to said line receiver means for generating handshake signals and being responsive to signals received by said line receiver means from said transmitter; and said operating means being responsive to signals received by said receiver means to produce a kiss-off signal;

said transmitter handshake signal having a given format;

said operating means being connected to said line receiver means for generating a plurality of handshake signals sequentially one after the other with each handshake signal having a different data format including the given format to which the transmitter is responsive, for sensing an incoming signal received by said line receiver means from said transmitter, and producing a kiss-off signal only in response to an incoming signal received by said line receiver means from said transmitter.

10. A digital alarm receiver as in claim 9, wherein said operating means produces said handshake signals of different format as a plurality of differently pulsed dual-tone multi-frequency handshake signals.

11. A digital alarm receiver as in claim 9, wherein the transmitter is responsive to a plurality of given handshake data formats fewer in number than the plurality of sequential handshake signals; and said operating means is responsive to signals received by said line receiver means for sensing an incoming signal received by said line receiver means from said transmitter.

12. A digital alarm receiver as in claim 11, wherein said operating means produces said handshake signals of different format as a plurality of differently pulsed dual-tone multi-frequency handshake signals.

13. A digital alarm receiver as in claim 9, wherein said operating means is connected to said line receiver means for producing a kiss off signal having the same format as the format of the handshake signal.

14. A digital alarm receiver as in claim 9, wherein said operating means is connected to said line receiver means for producing a kiss off signal having a same format different from the format of the handshake signal.

* * * * *